United States Patent [19]

Ohkura

[11] Patent Number: 4,957,408

[45] Date of Patent: Sep. 18, 1990

[54] DEVICE FOR CONTROLLING A FORK OF A FORKLIFT

[75] Inventor: Akira Ohkura, Toyota, Japan

[73] Assignee: Toyota Jidosha Kabushiki Kaisha, Japan

[21] Appl. No.: 178,233

[22] Filed: Apr. 6, 1988

[51] Int. Cl.[5] ..... B66F 9/06

[52] U.S. Cl. ..... 414/635; 414/638; 414/636; 414/785; 414/673; 414/21; 414/642; 414/273; 364/478; 364/424.05; 187/9 E

[58] Field of Search ..... 414/592, 273, 785, 601, 414/602, 628, 629, 630, 631, 632, 633, 634, 635, 636, 637, 638, 640, 641, 642, 644, 662, 663, 664, 673, 700, 699; 187/9 E, 9 R; 364/478, 424; 212/148, 158, 154, 185, 136

[56] References Cited

U.S. PATENT DOCUMENTS

| | | | |
|---|---|---|---|
| 3,386,603 | 6/1968 | Rueb | 414/636 |
| 3,410,433 | 11/1968 | Brown | 414/700 |
| 3,865,265 | 2/1975 | Brudi et al. | 414/635 |
| 4,221,530 | 9/1980 | Williams et al. | 414/673 |
| 4,491,918 | 1/1985 | Yuki et al. | 414/636 X |
| 4,632,630 | 12/1986 | Maki et al. | 414/700 |
| 4,747,610 | 5/1988 | Yingling et al. | 414/785 X |

FOREIGN PATENT DOCUMENTS

| | | | |
|---|---|---|---|
| 39947 | 9/1973 | Australia | 414/642 |
| 633548 | 12/1961 | Canada | 414/21 |
| 2819256 | 11/1979 | Fed. Rep. of Germany | 414/700 |
| 3542619 | 6/1987 | Fed. Rep. of Germany | 414/785 |
| 51-39856 | 4/1976 | Japan . | |
| 62-113198 | 7/1987 | Japan . | |

OTHER PUBLICATIONS

U.S. patent application Ser. No. 07/178,211 filed Apr. 6, 1988.

*Primary Examiner*—Frank E. Werner
*Attorney, Agent, or Firm*—Finnegan, Henderson, Farabow, Garrett & Dunner

[57] ABSTRACT

When the center of gravity of the load put on the two prongs of a forklift is located to the right or left of the central position, the prongs are tilted. The invention is intended to prevent the prongs from tilting in this situation. Tilt sensors are mounted on the prongs. A computer calculates the tilt angles of the prongs, based on the output signals from the sensors. A driving device receives the output signals from the computer and brings the prongs into the horizontal.

8 Claims, 4 Drawing Sheets

DEVICE FOR CONTROLLING A FORK OF A FORKLIFT

BACKGROUND OF THE INVENTION

1. Field of the Invention

The present invention relates to a forklift which detect when its two prongs deviate from the horizontal and automatically corrects the posture of the prongs.

2. Description of the Prior Art

It is necessary to maintain the two prongs of a forklift in the horizontal at all times without being affected by the weight of the load. However, when a heavy load is put on the prongs, it is inevitable that the prongs sink forward, dropping the load. A forklift disclosed in Japanese Patent Laid-Open No. 39856/1976 is equipped with a tilt device which corrects the posture of the prongs. When the prongs are tilted, the device operates to restore the prongs to the horizontal. This device has a mast, and if this mast is vertical, it is assumed that the prongs are kept in the horizontal. Since such an assumption is made, the posture cannot be perfectly controlled. Accordingly, Japanese Utility Model Laid-Open No. 113198/1988 (Application No. 204173/1985) discloses a forklift equipped with a tilt-modifying means. The angle of the prongs to the body of the forklift is detected, and the operation of the modifying means is controlled according to the result of the detection. The prongs can be maintained in the horizontal by this technique, but when the center of gravity of the load deviates greatly right or left from the central position, the forklift cannot cope with this situation.

SUMMARY OF THE INVENTION

The present invention lies in a forklift comprising: two prongs having horizontal portions; tilt sensors mounted either at the front ends or in the centers of the horizontal portions of the prongs; a computer which calculates the angles of tilt of the prongs, based on the output signals from the sensors; and a driving device which receives the output signal from the computer and brings the prongs into the horizontal. When the center of gravity of the load deviates greatly right or left from the central position, the tilts of the prongs are controlled to control the posture of the load.

It is an object of the invention to provide a forklift which performs a control operation to always maintain the two prongs in the horizontal even if the center of gravity of the load on the prongs is located to the left or right of the central position.

BRIEF DESCRIPTION OF THE DRAWINGS

The manner by which the above and other objects are obtained will be fully apparent from the following detailed description when considered with the accompanying drawings, wherein.

DETAILED DESCRIPTION OF THE INVENTION

Figure 1:
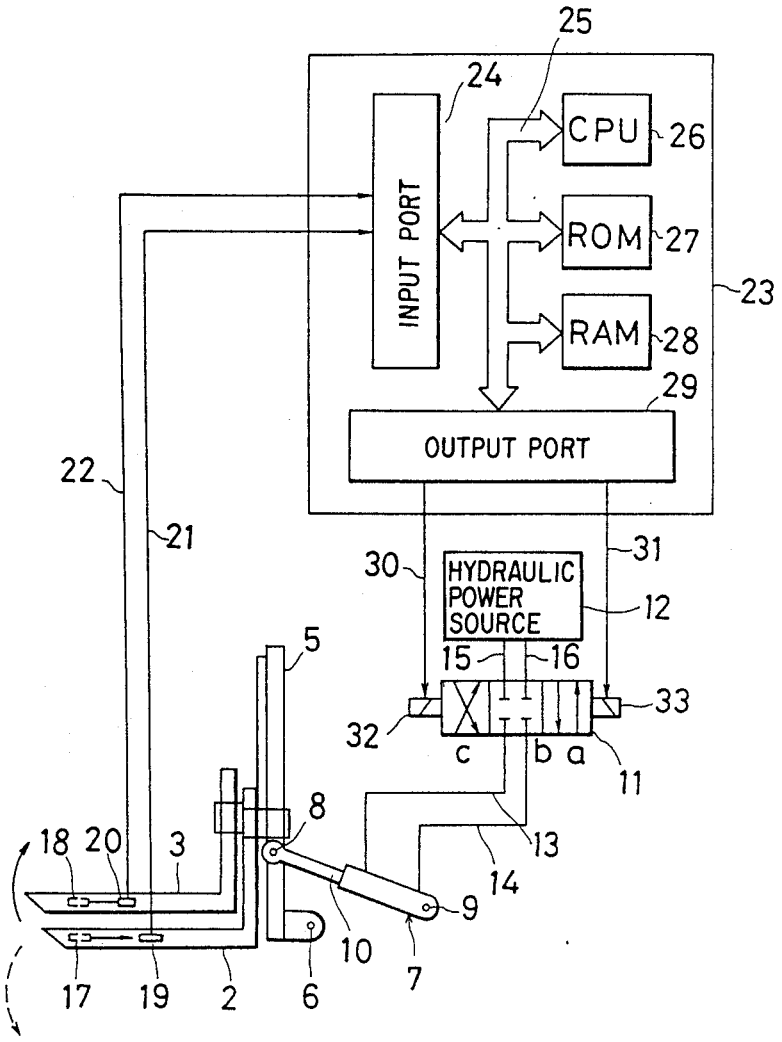
FIG. 1 is a block diagram of a forklift according to the invention.
Figure 6:
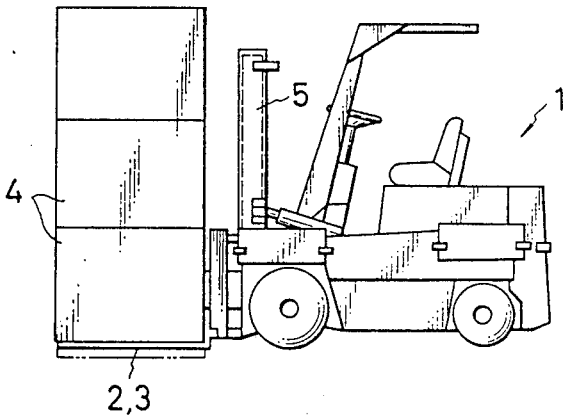
FIG. 6 is a side elevation of a forklift.

Referring to FIGS. 1 and 6, a forklift, generally indicated by numeral 1, has a master 5. Two prongs 2 and 3 which are moved up and down along the mast 5 by a conventional driving mechanism (not shown) are held to the mast 5. The mast 5 can be rotated relative to the body of the forklift about a shaft 6 at the lower end of the mast. A cylinder mechanism 7 is mounted between an intermediate portion of the mast 5 and a portion of the body of the forklift. Both ends of the cylinder mechanism 7 are pivotally mounted to these portions by shafts 8 and 9. The cylinder mechanism 7 has a rod 10 which expands and contracts to control the angular position of the mast 5. The cylinder mechanism 7 is connected to a hydraulic power source 12 via a three-position solenoid valve 11 having three ports a, b, c. Hydraulic pipes 13 and 14 are connected between the valve 11 and the cylinder mechanism 7. Hydraulic pipes 15 and 16 are connected between the power source 12 and the valve 11.

Tilt sensors 17 and 18 are mounted on the prongs 2 and 3, respectively, at locations which are close to the front ends of the prongs and at which the sensors are unaffected by the load. The sensors 17 and 18 are connected with amplifiers 19 and 20, respectively, which are connected with the input port 24 of an electronic control device 23 via lead wires 21 and 22, respectively. The input port 24 is connected to a CPU (central-processing unit) 26, a ROM (read-only memory) 27, a RAM (random-access memory) 28, and an output port 29 via a bus 25. The aforementioned three-position solenoid valve 11 has solenoids 32 and 33 which are connected to the output port 29 via lead wires 30 and 31, respectively.

In the forklift 1 constructed as described above, hydraulic pressure is supplied to the cylinder mechanism 7 from the hydraulic power source 12 to advance or retract the rod 10 causing the mast 5 to be rotated about the shaft 6. Thus, the prongs 2 and 3 can be maintained parallel in the horizontal. When the three-position solenoid valve 11 assumes the position of the port a, the cylinder mechanism 7 retracts the rod 10. At this time, the mast 5 turns about the shaft 6 in a clockwise direction as viewed in FIG. 1. As a result, the front end of the prong 2 or 3 is raised as indicated by the arrow of a solid line. When the valve 11 takes the position of the port c, the front end of the prong 2 or 3 is lowered as indicated by the arrow of a broken line. When the valve assumes the position of the port b, the posture of the prongs 2 or 3 is not changed.

When a load is put on the prongs 2 and 3 and the weight of the load is distributed uniformly between the two prongs, then no problems occur. However, if the weight is not distributed uniformly, various problems take place as mentioned previously. In the novel apparatus, the tilts of the prongs 2 and 3 are detected by the sensors 17 and 18, respectively. The output signals from the sensors 17 and 18 are amplified by the amplifiers 19 and 20, respectively. The output signals from the amplifiers are fed to the input port 24 of the electronic control device 23, which controls the angular positions of the prongs 2 and 3 according to its input signals.

Figure 2:
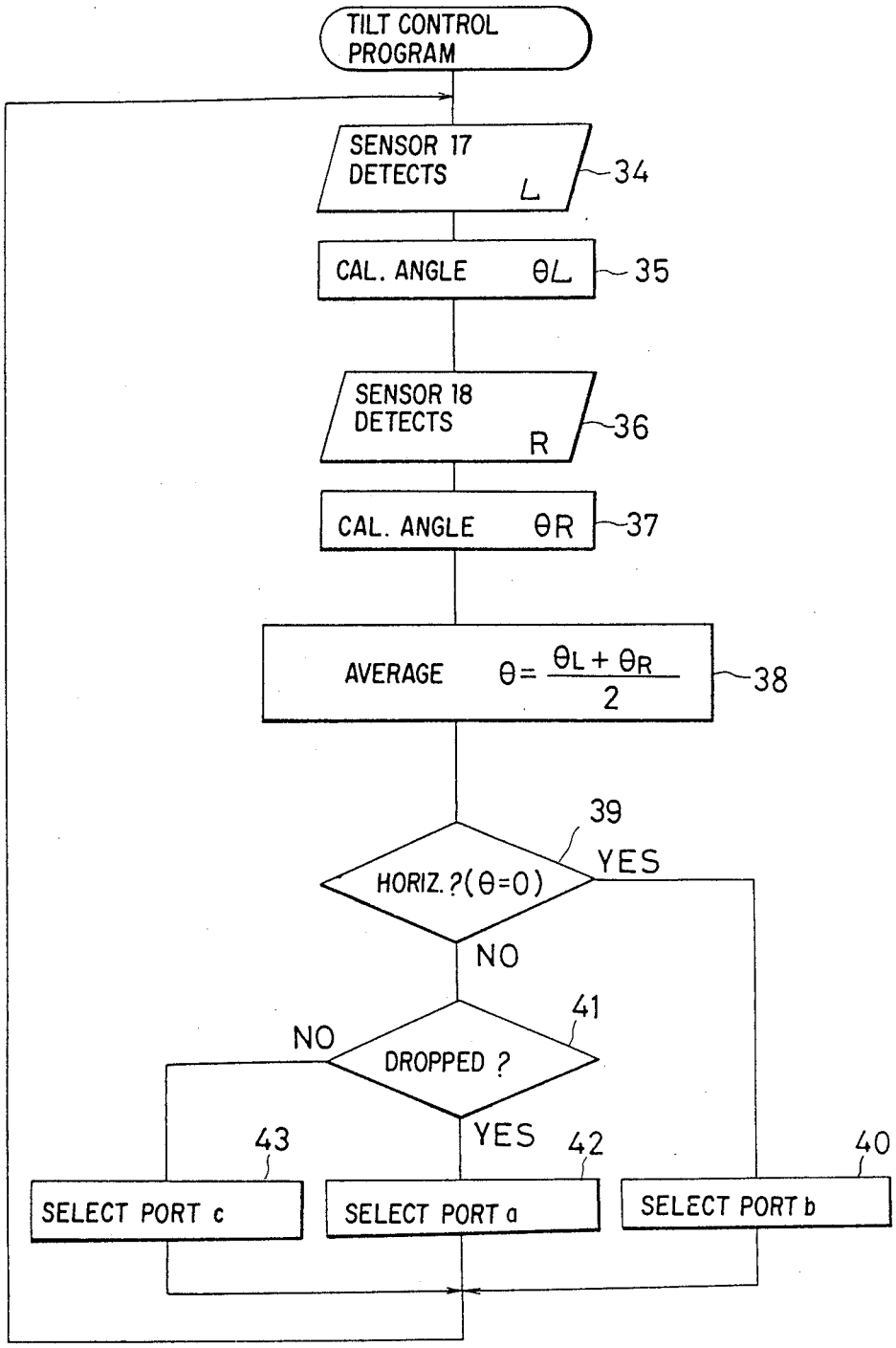
FIG. 2 is a flowchart for illustrating the operation of the forklift shown in FIG. 1.

When the difference between the tilt angles of the prongs 2 and 3 lies within a tolerable range, no correcting operation is carried out. When the difference exceeds the range, a correcting operation is performed. An operation to make the prongs horizontal is described next by referring to the flowchart of FIG. 2. When the tilt sensor 17 detects the tilt of the left prong 2 (step 34), the CPU 26 calculates the angle of tilt $\theta_L$, based on the output signal from the sensor 17 (step 35). When the sensor 18 detects the tilt of the right prong 3 (step 36), the CPU 26 calculates the angle of tilt $\theta_R$ (step 37).

Thereafter, the average $\theta$ of the tilt angles $\theta_L$ and $\theta_R$ is calculated (step 38). A decision is made to determine whether the average $\theta$ is equal to null or not, in order to ascertain whether the prongs are in the horizontal (step 39). If so, the port b of the three position solenoid valve 11 is selected (step 40). Then, this condition is maintained. If not so, a calculation is performed to determine whether the front ends of the prongs 2 and 3 sink out of the horizontal (step 41). If they are found to sink, the port b is selected (step 42). If they do not sink, the port c is selected (step 43), and the front ends of the prongs 2 and 3 are lowered.

In this way, the tilts of the two prongs 2 and 3 are controlled according to their average value. Therefore, even if the center of gravity of the load deviates from the center of the prongs 2 and 3, it is unlikely that the load drops. The aforementioned calculations are effected by the CPU 26 of the electronic control device 23. The ROM 27 stores maps used for estimating the angles of the prongs 2 and 3 to the horizontal, as well as a program for controlling the tilts. The RAM 28 temporarily stores information.

Figure 3:
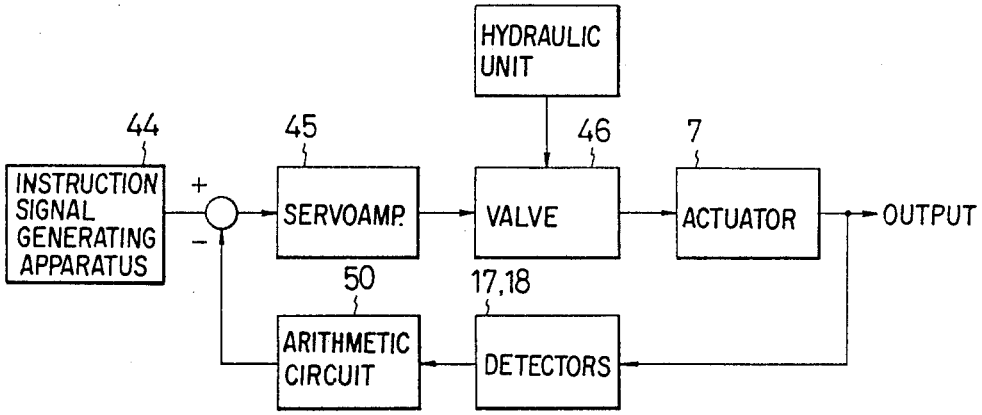
FIG. 3 is a block diagram of another apparatus according to the invention.
Figure 4:
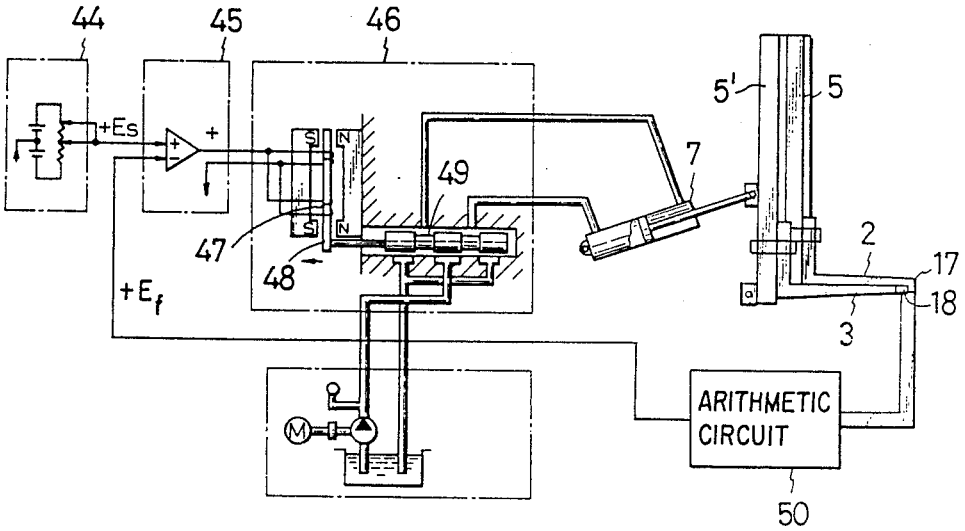
FIG. 4 is a diagram of a system embodying the apparatus shown in FIG. 3.
Figure 5:
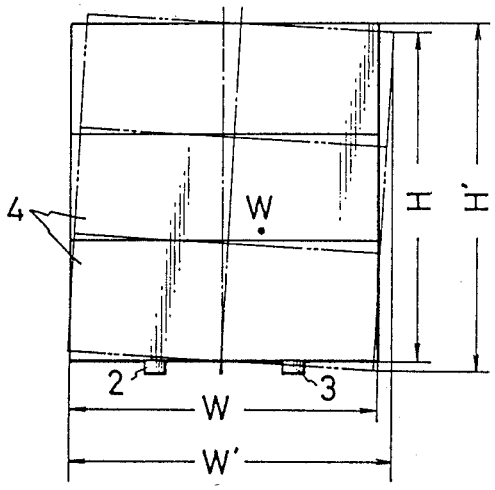
FIG. 5 is a schematic representation of two prongs on which a load is put, for illustrating the manner in which the load is tilted.

Referring to FIGS. 3 and 4, there is shown another example of the invention. As illustrated in FIG. 4, prongs 2 and 3 are supported by prongs 5 and 5', respectively. Prong 5' is associated with the servo valve 46 and actuator 7. Though FIG. 4, illustrates only servo valve 46 and actuator 7, it is necessary to provide an actuator system as illustrated in FIG. 3 for prong 5 also. The prongs 2 and 3 are maintained in the horizontal by an electrohydraulic servo system including an instruction signal-generating apparatus 44 for producing an instruction signal. When this instruction signal is varied by $+E_s$ to bring the prongs into the horizontal, the input to a servo amplifier 45 changes to $+E_s$, producing a deviational signal $+E_s$. This signal is amplified by the servo amplifier 45 to energize the coil 47 of a servo valve 46 corresponding to the three-position solenoid valve 11 of the above example. Then, an armature 48 sets up an attracting force, and is angularly displaced. The spool 49 of a main guide valve connected with the armature 48 is displaced. The produced high pressure forces working fluid through the port toward the cylinder mechanisms 7, inclining the prongs 2 and 3.

The output signals from the tilt sensors 17 and 18 mounted at the front ends of the prongs 2 and 3 are fed to an arithmetic circuit 50 which calculates the average given by $\theta=(\theta_R+\theta_L)/2$. The arithmetic circuit 50 feeds a signal $+E_f$ back to the servo amplifier 45, which produces the difference between the instruction signal $+E_s$ and the signal $+E_f$ fed back to it. The amplifier 45 keeps energizing the servo valve 46 until the difference decreases down to zero, i.e., $(+E_s)-(+E_f)=0$. The cylinder mechanism 7 is made fixed at the point where the relation $+E_s=+E_f$ holds. In this state, the prongs 2 and 3 are placed in the horizontal. In this example, the prongs 2 and 3 can be quickly brought into the horizontal.

What is claimed is:

1. A device for controlling a fork of a forklift, the fork having means for supporting and guiding prongs and two prongs supported by and guided along a pair of generally vertical masts by the means for supporting and guiding, each prong having a tip end, comprising:

a pair of tilt sensors, each sensor mounted on a separate tip end of said prongs;

an electronic control device having an input port and an output port, each said sensor operatively connected to said input port of said electronic control device, said electronic control device generating output signals at said output port on the basis of signals derived from said tilt sensors input to said input port;

a shaft;

a pair of drive mechanisms, each drive mechanism rotating a separate one of the vertical masts about said shaft, said output signals connected to said drive mechanisms for causing independent movement of the directions and amounts of rotation of each of said generally vertical masts and the tilt of each prong so that each prong is maintained at a zero angle even if the center of gravity of a load on the prongs is not evenly shared by the prongs.

2. A device according to claim 1, wherein each said drive mechanism comprises a cylinder mechanism.

3. A device according to claim 1, wherein each said drive mechanism comprises a cylinder mechanism, a hydraulic power source, a three-position solenoid valve, said cylinder mechanism connected to said hydraulic power source via said three-position solenoid valve.

4. A device according to claim 3, wherein said three-position solenoid valve is controlled by said output signals.

5. A device according to claim 1, wherein a pair of amplifiers are connected between said tilt sensors, respectively, and said input port.

6. A system for controlling the tilt of a fork of a forklift truck having a pair of elongated adjacent masts, each pivotally mounted at one end on an axis, the fork having a prong mounted on each mast with the tilt angle of the prong being in accordance with the pivotal position of the corresponding mast; said system comprising:

sensing means mounted on each prong for detecting a tilt angle of the corresponding prong;

means responsive to the detected tilt angle of each prong for generating a signal corresponding to the tilt angle of the respective prong;

means governed by both of the generated tilt angle signals for calculating the average tilt angle of the prongs;

means for comparing the calculated average tilt angle with the angle zero; and means for varying the pivotal position of each mast based on the difference between the calculated average tilt angle and the angle zero.

7. A device for controlling a fork of a forklift, the fork having means for supporting and guiding prongs and two prongs supported by and guided along a pair of generally vertical masts by the means for supporting and guiding, each prong having a tip end, comprising:

a pair of tilt sensors, each sensor mounted on a separate tip end of said prongs;

an electronic control device having an input port and an output port, each said sensor operatively connected to said input port of said electronic control device, said electronic control device generating output signals at said output port on the basis of signals derived from said tilt sensors input to said input port;

a shaft;

at least one drive mechanism, said at least one drive mechanism rotating a corresponding one of the vertical masts about said shaft, said output signals connected to said drive mechanism for causing independent movement of the directions and amounts of rotation of said corresponding one of the generally vertical masts and the tilt of the respective prong so that said at least one prong is maintained at a zero angle at times when the center of gravity of a load on the prongs is not evenly shared by the prongs.

8. A systems for controlling the tilt of a fork of a forklift truck having a pair of elongated adjacent masts, each pivotally mounted at one end on an axis, the fork having a prong mounted on each mast with the tilt angle of the prong being in accordance with the pivotal position of the corresponding mast; said system comprising:

sensing means mounted on each prong for detecting a tilt angle of the corresponding prong;

means responsive to the detected tilt angle of each prong for generating a signal corresponding to the tilt angle of the respective prong;

means governed by both of the generated tilt angle signals for calculating the average tilt angle of the prongs;

means for comparing the calculated average tilt angle with the angle zero; and means for varying the pivotal position of at least one mast based on the difference between the calculated average tilt angle and the angle zero.

* * * * *